US005912655A

United States Patent [19]

Hoshino et al.

[11] Patent Number: 5,912,655

[45] Date of Patent: Jun. 15, 1999

[54] DISPLAY DEVICE

[75] Inventors: Masafumi Hoshino; Shuhei Yamamoto; Hiroyuki Fujita; Hirotomo Oniwa; Kentaro Yagi; Fujio Matsu, all of Chiba, Japan

[73] Assignee: Seiko Instruments Inc., Japan

[21] Appl. No.: 08/395,429

[22] Filed: Feb. 28, 1995

[51] Int. Cl.[6] ..... G09G 3/36

[52] U.S. Cl. ..... 345/100; 345/95; 345/211

[58] Field of Search ..... 345/100, 87, 94, 345/95, 204, 208, 209, 211, 212; 359/54, 55; 315/160; 349/33, 36

[56] References Cited

U.S. PATENT DOCUMENTS 5,229,761 7/1993 Fuse ..... 345/211
5,485,173 1/1996 Schetter ..... 345/87
5,598,180 1/1997 Suzuki et al. ..... 345/211

FOREIGN PATENT DOCUMENTS 4322666 1/1994 Germany .
2271458 4/1994 United Kingdom .

*Primary Examiner*—Dennis-Doon Chow
*Attorney, Agent, or Firm*—Adams & Wilks

[57] ABSTRACT

A display device includes a liquid crystal panel, a controller, a common driver and a segment driver. The common driver is powered by a high power supply voltage and outputs row driving waveforms having predetermined voltage levels, which are relatively high. The segment driver is powered by a low power supply voltage and outputs column driving waveforms having predetermined voltage levels, which are relatively low. By this construction, it is not necessary for both the segment and common drivers to be high withstand voltage integrated circuit devices.

11 Claims, 8 Drawing Sheets

6

DISPLAY DEVICE

BACKGROUND OF THE INVENTION

The present invention relates generally to a display apparatus which uses a simple matrix type liquid crystal panel. In particular, the present invention relates to a liquid crystal display device utilizing multi line selection addressing. In still further detail, it relates to a power supply structure with respect to a common driver and segment driver included in the display device.

Simple matrix type liquid crystal panels support a liquid crystal layer between orthogonally arranged and opposed row electrodes and column electrodes defining a plurality of pixels arranged in matrix form. Conventionally, the most relevant liquid crystal panel to this invention is driven by a voltage averaging method. This method selects each row electrode one at a time in sequence, and imparts a data signal corresponding to an ON/OFF display state to all column electrodes in accordance with a selected timing. As a result, the voltage applied to each pixel serves as a high application voltage only once (for a 1/N time period) during one frame interval, in which all the row electrodes (N electrodes) are individually selected sequentially, and during the remaining time period ((N−1)/N) a constant bias voltage is applied. When the response speed of the liquid crystal material used is slow, a change in brightness according to the effective value of the application voltage waveform in one frame interval may be observed. Consequently, when a frame frequency taking a large division number decreases, the difference between one frame interval and the response time of the liquid crystal becomes small, the liquid crystal respond to each applied pulse, and contrast in which flickering of the brightness appears, which is known as "frame response", is reduced.

A "Multi Line Selection Addressing Method" has been proposed as a manner of dealing with the problem of frame response, and is disclosed in, for example, Published Japanese Patent Application 5-100642. One example of a display device using a liquid crystal panel driven by this method is shown in FIG. 8. This multi line selection addressing method, by selecting a number of row electrodes simultaneously rather than conventional line by line selection, executes visible high frequency display and suppresses the above-described frame response. Since it selects a number of row electrodes simultaneously rather than selecting line by line, a means is required to obtain an appropriate pixel display. In other words, it is necessary to perform a calculation process on the original pixel data prior to applying it to the column electrodes. Specifically, a controller 101 is provided for producing orthonormal signals represented by the set of orthonormal functions, producing a sum of product signal in accordance with a result of performing a sum of product calculation with a set of the orthonormal functions and a set of selected pixel data. A common driver 102 applies a row driving waveform having a predetermined voltage level (+Vr, Vo, −Vr) to the row electrodes of a liquid crystal panel 103 by group sequential scanning in each selection time period, according to the orthonormal signals. Meanwhile, a segment driver 104 applies a column driving waveform having a predetermined voltage level (V1, V2, . . . Vn−1, Vn) to the column electrodes of the liquid crystal panel 103 in synchronization with the group sequential scanning, according to the sum of product signals.

To continue, the problems of conventional techniques will be briefly explained with reference to FIG. 8. Generally, while the common driver 102 and segment driver 104 for driving the liquid crystal panel 103 output a driving waveform of relatively high voltage level, the controller 101 performs only control with respect to the common driver 102 and the segment driver 104 and operates within a low voltage range in the same way as a normal IC. As a result, the conventional common driver 102 and segment driver 104 are connected with a high voltage power supply ($V_{DD}$, $-V_{LC}$), and the controller 101 is connected with a low voltage power supply ($V_{DD}$, GND). The common driver 102 and segment driver 104 are high withstand voltage ICs, and the controller 101 is a low withstand voltage IC.

Incidentally, the voltage level of the row driving wave form output by the common driver 102 and the voltage level of the column driving waveform output by the segment driver 104 do not include mutually equal voltage ranges, but change depending on and relative to the main number of row electrodes simultaneously selected at each selected time interval. Where the simultaneously selected main number is small compared to the total main number of row electrodes, the range of voltage levels on the common driver 102 side becomes relatively wide and the range of voltage levels on the segment driver side becomes narrow. Conversely, where the simultaneously selected main number becomes relatively large with respect to the total number of row electrodes, the range of voltage levels on the common driver 102 side becomes narrow and the range of voltage levels on the segment driver side becomes wide. Despite the fact that range of required voltage levels of the common driver 102 and the segment driver 104 differ in this way, because both drivers are supplied in common by a high voltage power supply, high withstand voltage ICs have been used for both. For example, with respect to the controller 101 being able to use a normal IC having a withstand voltage rate in the vicinity of 5 V, the driver ICs required a withstand voltage rate in the range of 30 V. In manufacturing this type of high withstand voltage IC special structures and processes are required, which is a problem from a financial aspect. For example, with a high withstand voltage IC special processes such as thickening of the gate insulation film, etc. are performed. Also, special structures such as a double-layer diffusion drain and lengthened gate lengths, etc. are employed to raise the withstand voltage. The result of this is that the chip size is enlarged and the cost is raised by the increase in manufacturing processes. Further, it is disadvantageous due to the increase in consumption current accompanying the raising of the power supply voltage, generation of noise, and the like.

SUMMARY OF THE INVENTION

The following means were devised to solve the problems of the prior art techniques described above. Namely, the display device of the present invention includes a liquid crystal panel supporting a liquid crystal layer between orthogonally opposed row electrodes and column electrodes and provides matrix arranged pixels, and is driven in a multi line selection addressing drives in accordance with input pixel data. Therefore, in addition to the liquid crystal panel, the display device has a controller, a common driver and a segment driver. The controller, as well as producing orthonormal signals represented by a set of orthonormal functions, produces a sum of product signals in accordance with a result of performing a sum of product calculation with a set of the orthonormal signals and a set of the pixel data. The common driver applies row driving waveforms having a predetermined voltage level to the row electrodes by group sequential scanning at selected intervals in accordance with the orthonormal signals. The segment driver applies a column driving waveform having a predetermined voltage level to the column electrodes in synchronization with the group sequential scanning and in accordance with the sum of product signals. In this type of structure, the common driver and segment driver are characterized by being separately powered by a pair of power supplies having different power supply voltages.

As one aspect of the present invention, while the common driver is supplied by a high voltage power supply and outputs a row driving waveform of relatively high voltage level, the segment driver is supplied by a low voltage power supply and outputs a column driving waveform of relatively low voltage level. For example, the high voltage power supply has a power supply voltage surpassing 10 V, and the low voltage power supply has a power supply voltage not surpassing 10 V. Further, the controller is supplied power by a low voltage power supply in common with the segment driver. In this case, the low voltage power supply may have a power supply voltage in the vicinity of 5 V in combination with a voltage input level of the controller. Further, since the segment driver outputs a column driving waveform having a voltage falling within a range in the vicinity of 5 V, the common driver performs group sequential scanning of 15 or less row electrodes as one set so as to satisfy that condition. For example, the common driver performs group sequential scanning of 6 line electrodes as one set. According to another aspect of the present invention, a central potential of a power supply voltage output by the high voltage power supply and a central potential of a power supply voltage output by low voltage power supply are both substantially in agreement. The display device further includes a voltage level circuit, which divides a power supply voltage output by the high voltage power supply to produce a plurality of divided voltage levels, and supplies the divided voltages to the segment driver for use in forming the column driving waveform. In addition, it includes a level shifter and level shifts the orthogonal signal output from the controller connected to the low voltage power supply side to input it to the common driver connected to the high voltage power supply side. Alternatively, in place thereof, the common driver connected to the high voltage power supply side incorporates an input comparator, and can directly receive the orthonormal signal output from the controller connected to the low voltage power supply side.

A block drawing showing the basic structure of the display device of the present invention.

[FIG. 2]

Figure 1:
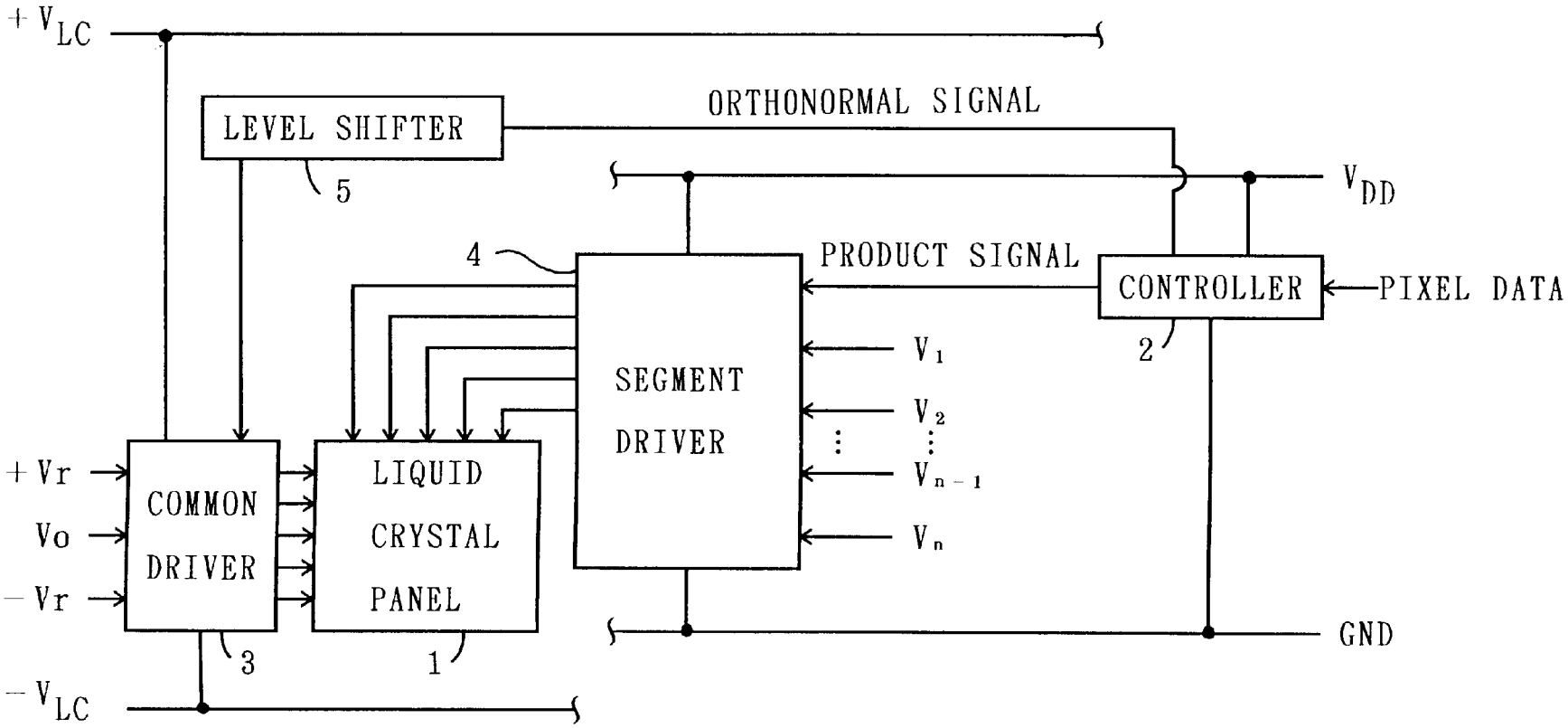
[FIG. 1]

A block drawing showing a variation example of the display device shown in FIG. 1.

[FIG. 3]

A circuit drawing showing a concrete structural example of the display device shown in FIG. 1.

[FIG. 4]

Figure 3:
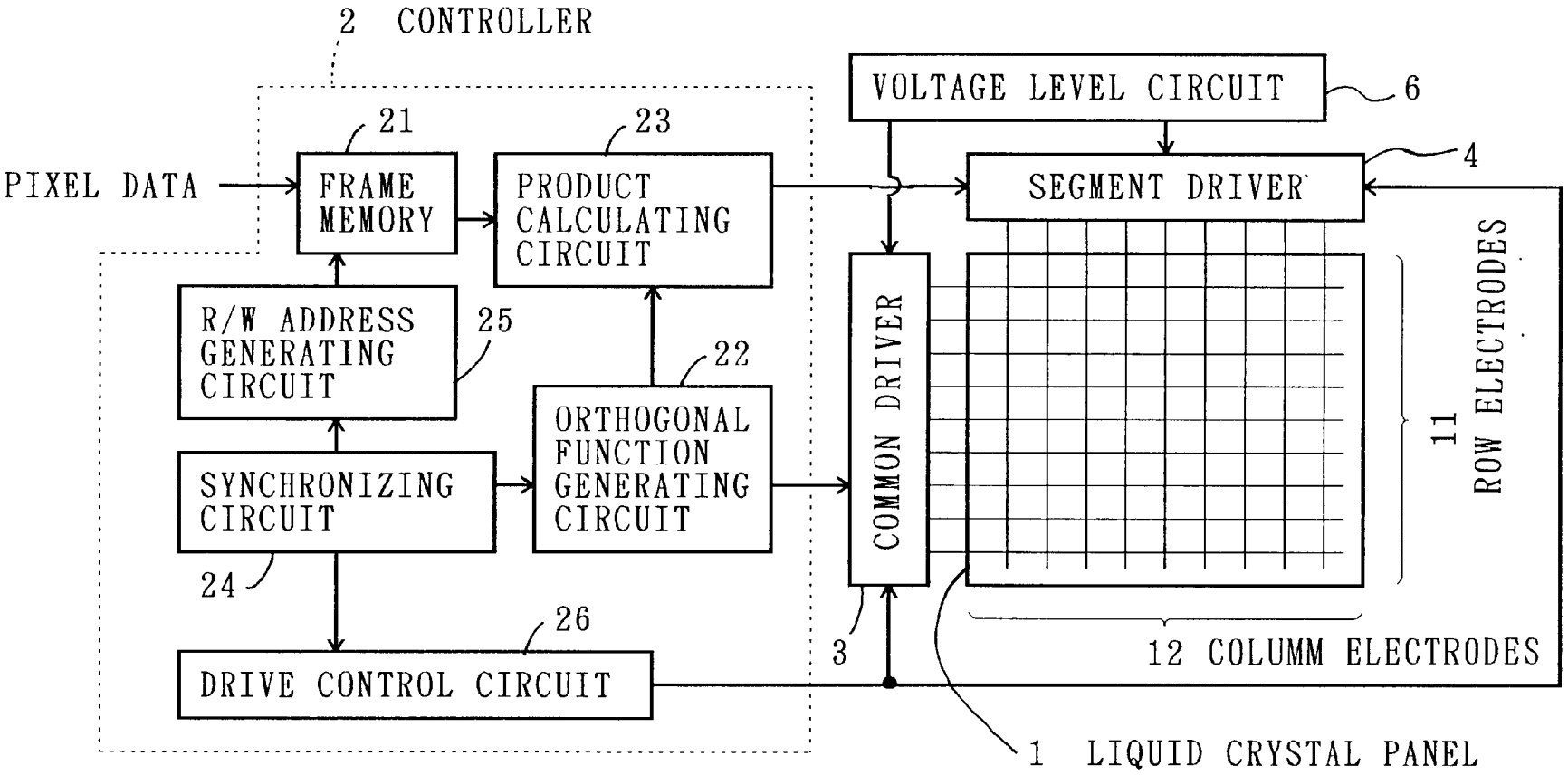

A timing chart which accompanies an operational explanation of the display device shown in FIG. 3.

[FIG. 5]

A wave form chart which similarly accompanies an operational explanation of the display device shown in FIG. 3.

[FIG. 6]

A circuit drawing showing a structural example of a voltage level circuit incorporated in the display device shown in FIG. 3.

[FIG. 7]

Figure 6:
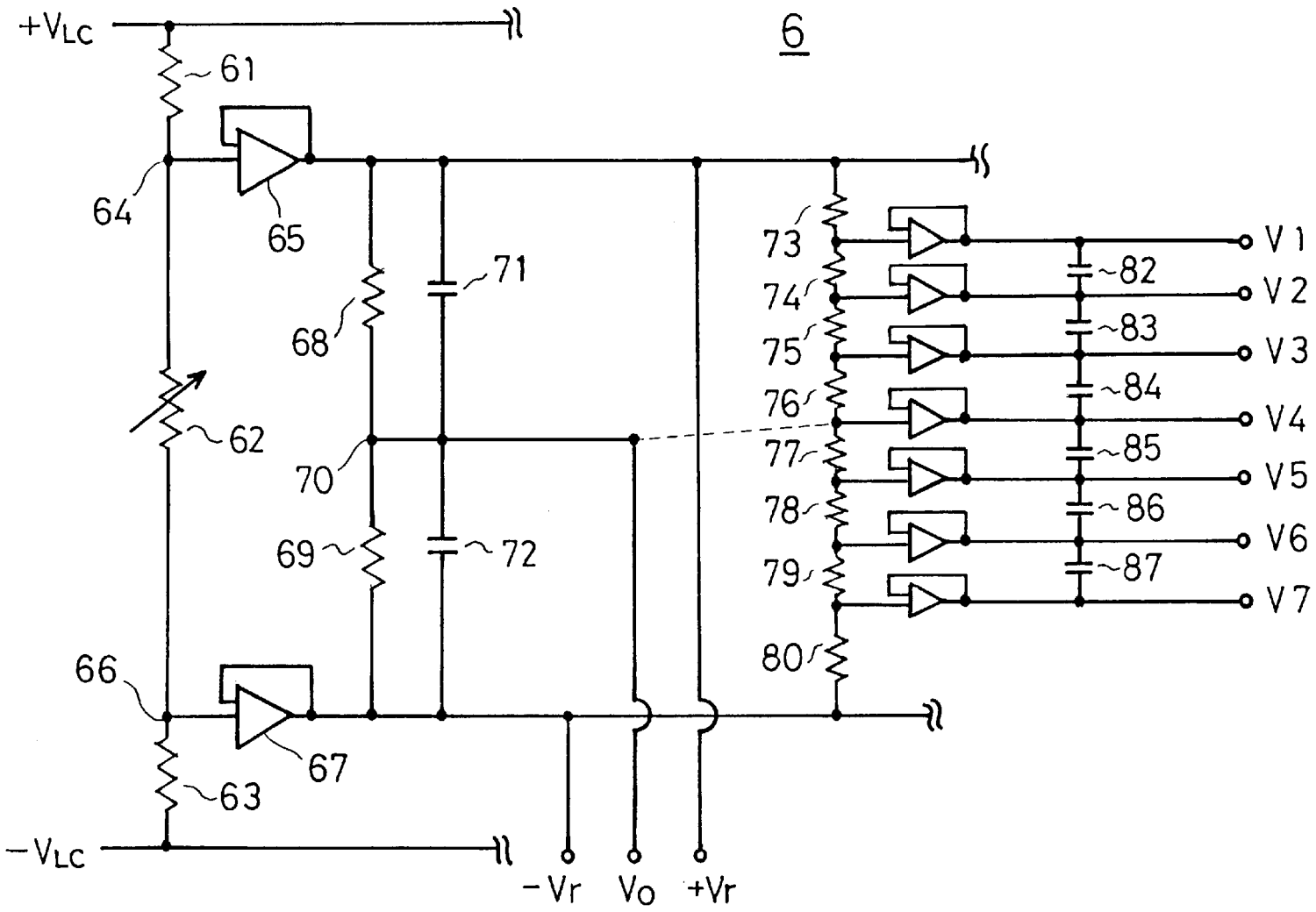

A voltage level chart which accompanies an operational explanation of the voltage level circuit shown in FIG. 6.

[FIG. 8]

A block drawing showing an example of a conventional display device.

DETAILED DESCRIPTION OF THE INVENTION

According to the present invention the common driver and segment driver are separately supplied by a pair of power supplies having different power supply voltages. In other words, according to each of the voltage level of the row driving waveform output from the common driver and the voltage level of the column driving waveform output from the segment driver, power sources having appropriate power supply voltages are separately prepared and connected. For example, while the common driver is connected to a high voltage power supply, the segment driver is connected to a low voltage power supply. By means of this type of structure, low suppression of the withstand voltage of at least one driver becomes possible, and an IC produced by normal processing can be used. Further, if the controller is connected to the low voltage power supply side in common with the segment driver, the circuit structure is simplified. For example, it is permissible to connect in common a controller and segment driver having a withstand voltage rate in the vicinity of 5 V to a low voltage power supply side.

Below, preferred embodiments of the present invention will be explained in detail with reference to the drawings. FIG. 1 is a block drawing showing the basic structure of a display device according to the present invention. As shown in the drawing, this display device is formed from a liquid crystal panel 1, a controller 2, a common driver 3, a segment driver 4, a level shifter 5, and so on. The liquid crystal panel 1 supports a liquid crystal layer between orthogonally opposing row electrodes and column electrodes defining a plurality of pixels arranged in a matrix form. The controller 2, as well as producing an orthonormal signal represented by a set of orthonormal functions, produces a sum of product signals in accordance with a result of performing a sum of product calculation with a set of the ortholnormals functions and a set of pixel data. The common driver 3 is connected to the controller 2 via the level shifter 5, and applies a row driving waveform having a predetermined voltage level (+Vr, Vo, −Vr) to the row electrodes of the liquid crystal panel 1 by group sequential scanning at selected intervals, in accordance with the orthonormal signals. Meanwhile, the segment driver 4 applyies a column driving waveform having a predetermined voltage level (V1, V2, . . . Vn−1, Vn) to the column electrodes of the liquid crystal panel 1 in synchronization with the group sequential scanning, in accordance with the sum of product signals.

As a feature of the present invention, the common driver 3 and segment driver 4 are separately powered by a pair of power supplies having different power supply voltages. In the present embodiment, the common driver 3 is powered by a high voltage power supply ($+V_{LC}$, $-V_{LC}$) and outputs a relatively high voltage level row driving waveform. Meanwhile, the segment driver 4 is supplied by a low voltage power supply ($V_{DD}$, GND) and outputs a relatively low voltage level column driving waveform. In the present embodiment, while the high voltage power supply ($+VL_{LC}$, $-V_{LC}$) has a power supply voltage surpassing 10 V, the low voltage power supply ($V_{DD}$, GND) has a power supply voltage not surpassing 10 V. Also, the controller 2 is powered by the low voltage power supply ($V_{DD}$, GND) in common with the segment driver 4. This controller 2 is formed by an IC having for example a normal rated withstand voltage of 5 V. Similarly, the segment driver 4 is also formed by an IC of a rated withstand voltage of 5 V. Accordingly, the low voltage power supply ($V_{DD}$, GND) has a power supply voltage in the vicinity of 5 V in keeping with the rated withstand voltage of these ICs. With this relationship, the segment driver 4 outputs a column driving waveform which combines a plurality of voltage levels (V1, V2, . . . Vn−1, Vn) falling within a range in the vicinity of 5 V based on a sum of product signals. On the other hand, the common driver 3 performs group sequential scanning of 15 or less row electrodes as one set so as to satisfy the condition relating to the voltage level on the segment driver 4 side. For example, the common driver 3 performs group sequential scanning of 6 row electrodes as one set. In this case the voltage level (+Vr, Vo, −Vr) of the row driving waveform output by the common driver side falls under 30 V, and the power supply voltage of the high voltage power supply ($+V_{LC}$, $-V_{LC}$) is set in the vicinity of 30 V.

In the present embodiment, a central potential of a power supply voltage output by the high voltage power supply ($+V_{LC}$, $-V_{LC}$) and a central potential of a power supply voltage output by low voltage power supply ($V_{DD}$, GND) are both substantially in agreement. Further, it includes a voltage level circuit not shown in the drawings and as well as supplying a predetermined voltage level (+Vr, Vo, −Vr) to be used in synthesizing the row driving waveform with respect to the common driver 3, supplies a predetermined voltage level (V1, V2, . . . Vn−1, Vn) to be used in synthesizing the column driving waveform with respect to the segment driver 4. This voltage level circuit resistively divides the power supply voltage output from the high voltage power supply to produce a plurality of voltage levels (V1, V2, . . . Vn−1, Vn). Accordingly, it is very easy to make the central potential of the row driving waveform output from the common driver 3 side and the central potential of the column driving waveform output from the segment driver 4 conform, and complete alternating current driving of the liquid crystal panel can be realized.

Lastly, the level shifter 5 described above level shifts the orthonormal signal output from the controller 2 of the low voltage power supply side to input it to the common driver 3 on the high voltage power supply side. In the present embodiment the power supply of the controller 2 and the power supply of the common driver 3 are both separate and independent. Consequently, the level shifter 5 is used and level adjusting of the orthonormal signals is necessary. In other words, it is permissible to shift the level of the orthonormal signals so as to align it with the logic operation level in the interior of the common driver 3.

Figure 2:
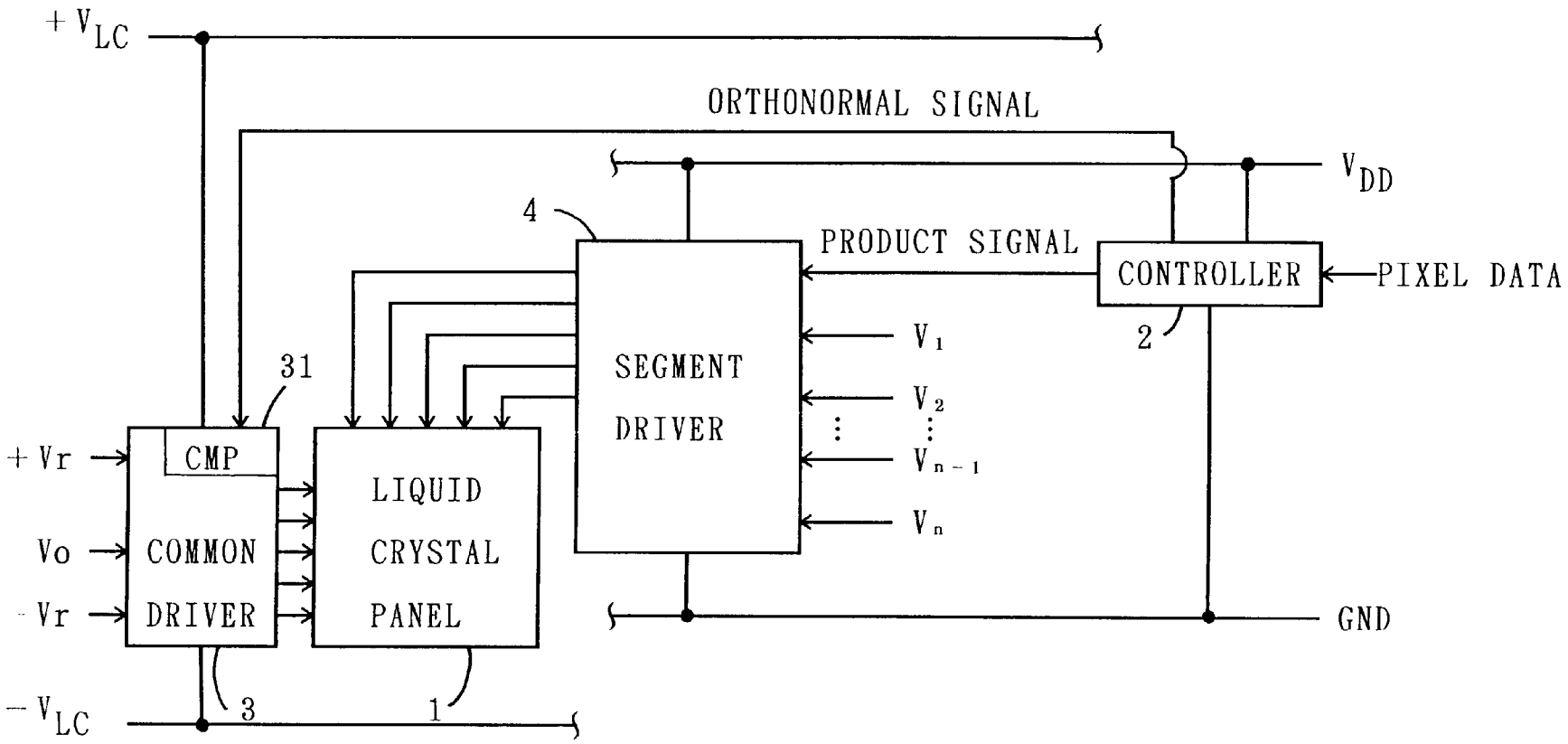

FIG. 2 is a block drawing showing a transformation example of the display device shown in FIG. 1. The basic structure is the same as the display device shown in FIG. 1, and corresponding reference numbers are attached to corresponding parts to accommodate understanding. A different item is that a comparator (CMP) 31 is incorporated in the input stage of the common driver 3 instead of the level shifter 5. The comparator 31 enables direct reception of the orthonormal signal output from the controller 2 on the low voltage power supply side. In other words, the comparator 31 provides a threshold level in agreement with a central level of the orthonormal signals, and an amplitude in the vicinity of 5 V is converted to an amplitude in the vicinity of 30 V.

FIG. 3 is a circuit drawing showing a concrete structural example of the display device shown in FIG. 1. As shown in the drawing, the present display device provides a simple matrix type liquid crystal panel 1. This liquid crystal panel 1 has an flat panel structure which interleaves the liquid crystal layer between the the row electrodes 11 and the column electrodes 12. As a liquid crystal layer an STN liquid crystal for example can be used. The common driver 3 is connected to the row electrodes 11 to drive them. Also the segment driver 4 is connected to the column electrodes 12 to drive them.

The controller 2 comprises a frame memory 21, an orthonormal function generating circuit 22 and a sum of product calculating circuit 23. The frame memory 21 stores by frame pixel data input from the outside. The pixel data is data indicating the density of pixels specified in intersecting portions of the row electrodes 11 and the column electrodes 12. The orthonormal function generating circuit 22 generates a number of orthonormal functions in a mutually orthonormal relationship, and forms an orthonormal signal in successive suitable combination patterns to supply it to the common driver 3. The common driver 3 selects a predetermined voltage level in accordance with the orthonormal signal and synthesizes a row driving waveform to apply it to the row electrodes 11 in group sequential scanning at each selected time interval. The sum of product calculating circuit 23 performs a predetermined sum of product calculation between a pixel data combination successively read out from the frame memory 21 and an orthonormal function combination transferred from the orthonormal function generating circuit 22, and supplies a sum of product signals to the segment driver based on the result. The segment driver 4 suitably selects a number of voltage levels according to the sum of product signal and synthesizes a column driving waveform, and supplies it to the column electrodes 12 each selected time interval while synthesizing it to the group sequential scanning. The number of voltage levels needed to form the column driving waveform are previously supplied from the voltage level circuit 6. Consequently, the segment driver 4 suitably selects a number of voltage levels according to the sum of product signal and supplies them to the column electrodes 12 as column driving waveforms. The voltage level circuit 6 also supplies a predetermined voltage level to the common driver 3. The common driver 3 suitably selects these voltage levels in accordance with the orthonormal signal, synthesizes a row driving waveform, and supplies it to the row electrodes 11.

The controller 2, in addition to the main structural components described above, further comprises a synchronizing circuit 24, a R/W address generating circuit 25, and a drive control circuit 26. The synchronizing circuit 24 mutually synchronizes pixel data read timing from the frame memory 21 and the signal transfer timing from the orthonormal function generating circuit 22. A desired pixel display can be obtained by repeating a number of times the group sequential scanning for one frame. The R/W address generating circuit 25 controls writing in and reading out of pixel data with respect to the frame memory 21. This address generating circuit 25 is controlled by the synchronizing circuit 24 and supplies predetermined read out address signals to the frame memory 21. The drive control circuit 26 receives the control of the synchronizing circuit 24 and supplies a predetermined clock signal to the common driver 3 and the segment driver 4.

Figure 4:
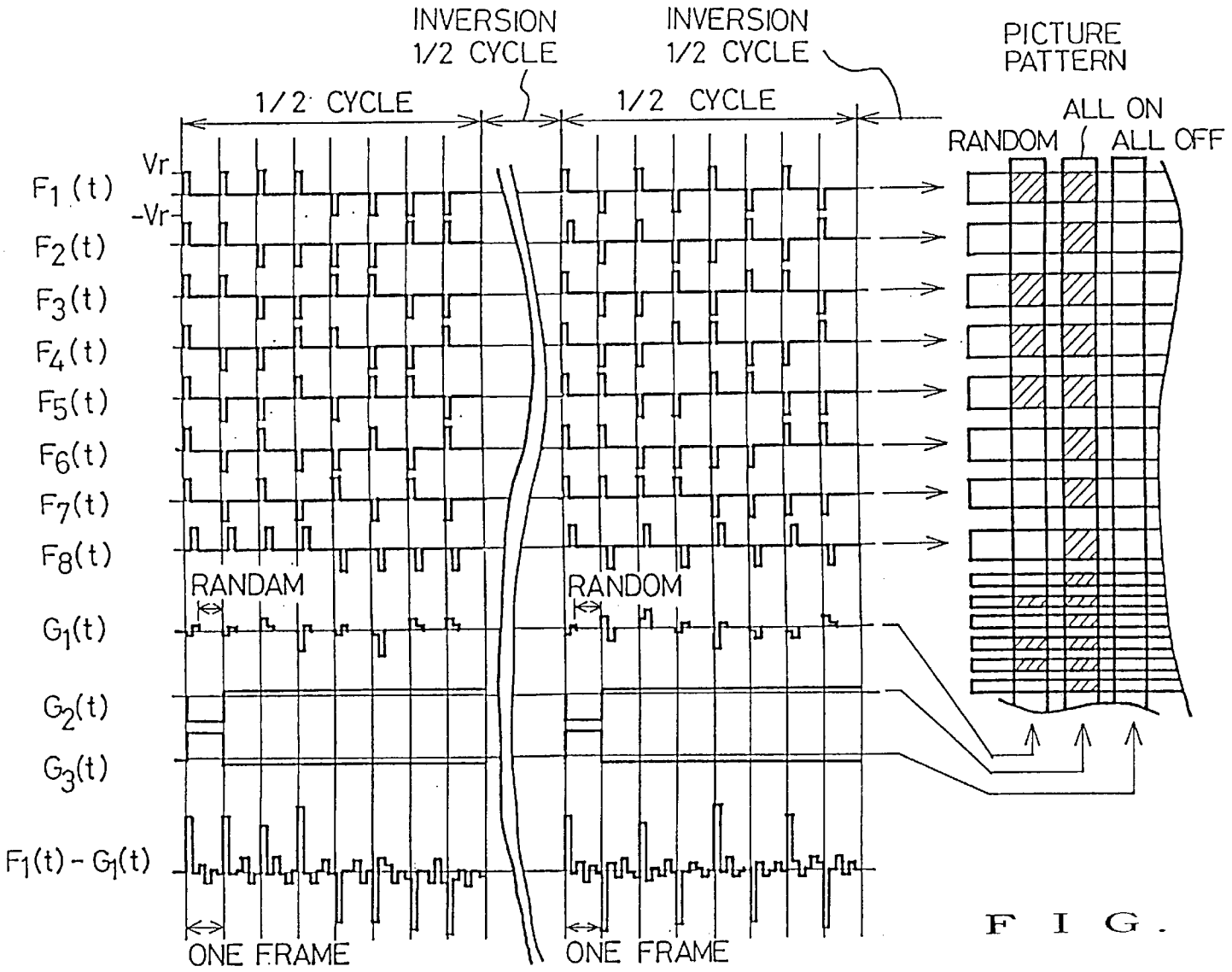

Below, a case wherein 6 row electrodes are simultaneously selected in a multi line selection addressing method will be explained in an example. FIG. 4 is a waveform drawing of 6-line simultaneously addressing. $F_1$ (t) to $F_7$ (t) are row driving waveforms applied to corresponding row electrodes, $G_1$ (t) to $G_3$ (t) indicate column driving waveforms applied to each column electrode. The row driving waveforms F are set based on a Walsh function, which is a complete regular orthonormal function, in (0, 1). Each voltage level is, in the case of 0, considered −Vr, in the case of 1 considered +Vr, and for the non-selection interval, Vo. The voltage level Vo of the non-selection interval is set at 0 V. From the top of the display panel, every 6 row electrodes are selected as one group and group sequentially scanned moving downwards. With 8 scannings the first half cycle corresponding to one cycle of the Walsh function is finished. In the next cycle polarity is reversed and the second half cycle performed so that direct current components are not introduced. Further, in the next cycle the orthonormal function combination pattern is reversed and a row driving waveform produced and supplied to the row electrodes. Vertical shift is not necessarily required.

Meanwhile, with regard to the column driving waveform applied to each column electrode, individual pixel data is considered $I_{ij}$ (where i indicates the row number of the matrix and j indicates similarly column number), and performs predetermined sum of product calculations. When the pixels are ON $I_{ij}=-1$, when OFF, $I_{ij}=+1$, under which condition, the driving waveform $G_j$ (t) imposed on every column electrode is set by performing basically the following sum of product calculation.

$$G_j(t) = 1\sum_{i=1}^{N} I_{ij} \times F_1(t) \qquad \text{[Expression 1]}$$

However, from the row driving waveform in the non-selection interval being 0 level, the calculation process in the above formula is the total only of the selected row. Consequently, in the case of 6-line simultaneous selection addressing, the potential at which column driving waveforms can be obtained is 7 level. In other words, the voltage level required in the column driving wave form is (simultaneous selection addressing main number +1) units. This voltage level is supplied from the voltage level circuit shown in FIG. 3, as described above. As can be understood from the above formula, in the case where the simultaneously selected main number is relatively small with respect to the total main number N of the row electrodes, the voltage level of the column driving waveform G is relatively low compared to the row driving waveform F.

Figure 5:
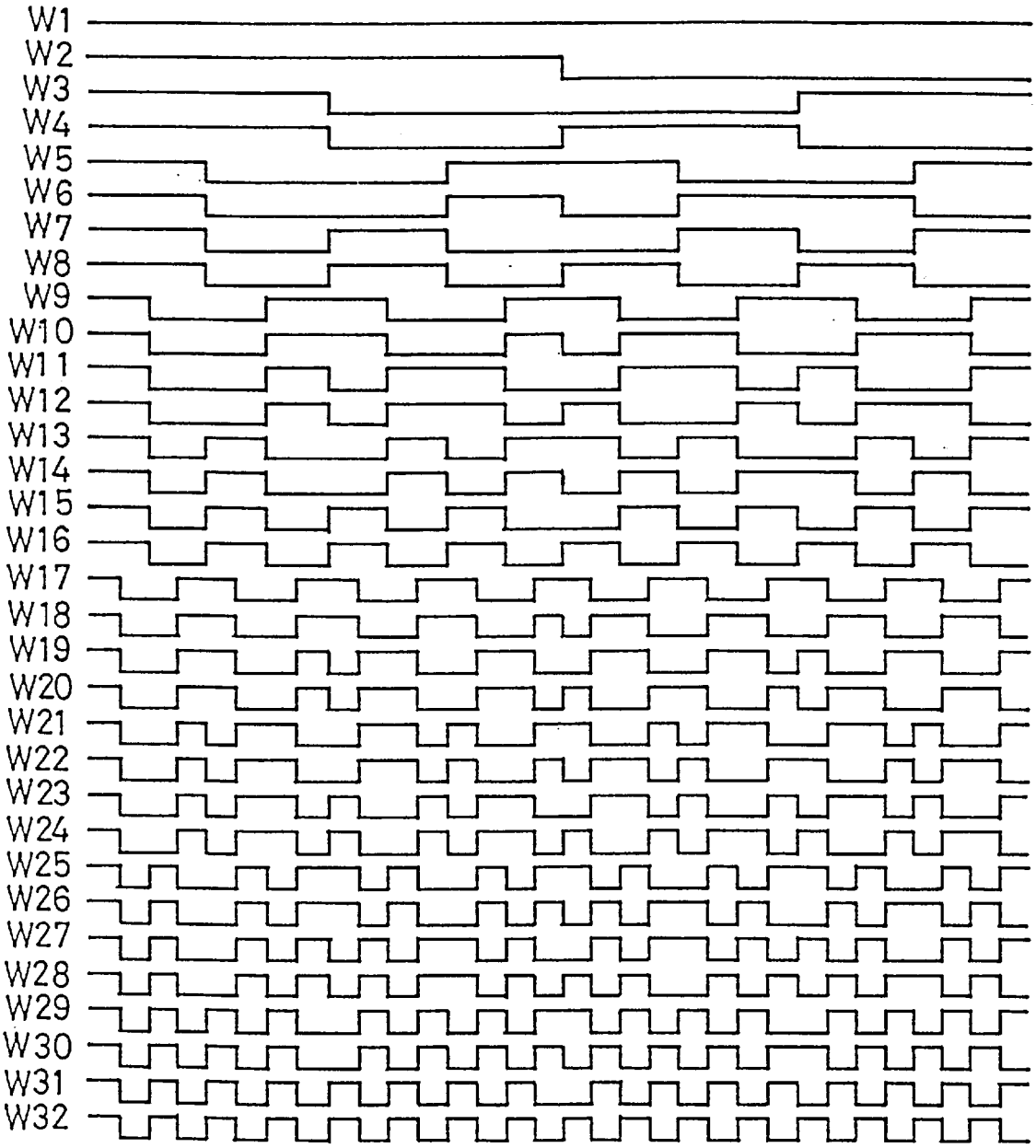

FIG. 5 is a wave form drawing showing a Walsh function. In the case of 6-line simultaneous selection addressing, a row driving waveform is produced using Walsh functions of 6 units from the second to the seventh, for example. As can be understood if contrasted to FIG. 4 and FIG. 5, $F_1$ (t) for example corresponds to the second Walsh function. This is a high level in the second half in one cycle, and low level in the second half. In accordance with this the pulse included in $F_1$ (t) is arrayed as (1, 1, 1, 1, 0, 0, 0, 0). In the same way, $F_2$ (t) corresponds to the third Walsh function, and its pulse is arrayed as (1, 1, 0, 0, 0, 0, 1, 1). Further, $F_3$ (t) corresponds to the fourth Walsh function and the pulse thereof is arrayed as (1, 1, 0, 0, 1, 1, 0, 0). As is apparent from the above explanation, the row driving wave form applied to one group row electrodes is expressed as suitable combination pattern based on an orthonormal function. In the case of FIG. 4, the row driving waveforms $F_7$ (t) to $F_{12}$ (t) are applied in accordance with the same combination pattern with respect to the second group. Below, in the same way, a predetermined row driving waveform is applied in accordance with the same combination pattern with respect to the third group onward.

FIG. 6 is a model circuit drawing showing a concrete structural example of the voltage level circuit 6 shown in FIG. 3. Between the positive/negative lines of the high voltage power supply ($+V_{LC}$, $-V_{LC}$), three resistors 61, 62 and 63 are connected in series. The voltage level +Vr is extracted from an upper node 64 via a buffer 65 by means of resistive division. Also, the voltage level −Vr is extracted from a lower node 66 via a buffer 67 by means of resistive division. The intermediate variable resistor 62 is used in voltage level adjustment. Resistors 68 and 69 are connected between the +Vr line and the −Vr line, and the third voltage level Vo is extracted via a central point node 70. These three voltage levels +Vr, −Vr and Vo are supplied to the common driver as explained above. Capacitors 71 and 72 are connected in an array to resistors 68 and 69.

Resistors 73 to 80 are connected in series between the row of +Vr and the row of −Vr. Seven voltage levels V1, V2, V3, V4, V5, V6 and V7 are extracted via a buffer from each node by individual resistive divisions. These 7 voltage levels are supplied to the segment driver as described above. Capacitors 82 to 87 are inserted between each output terminal.

Figure 7:
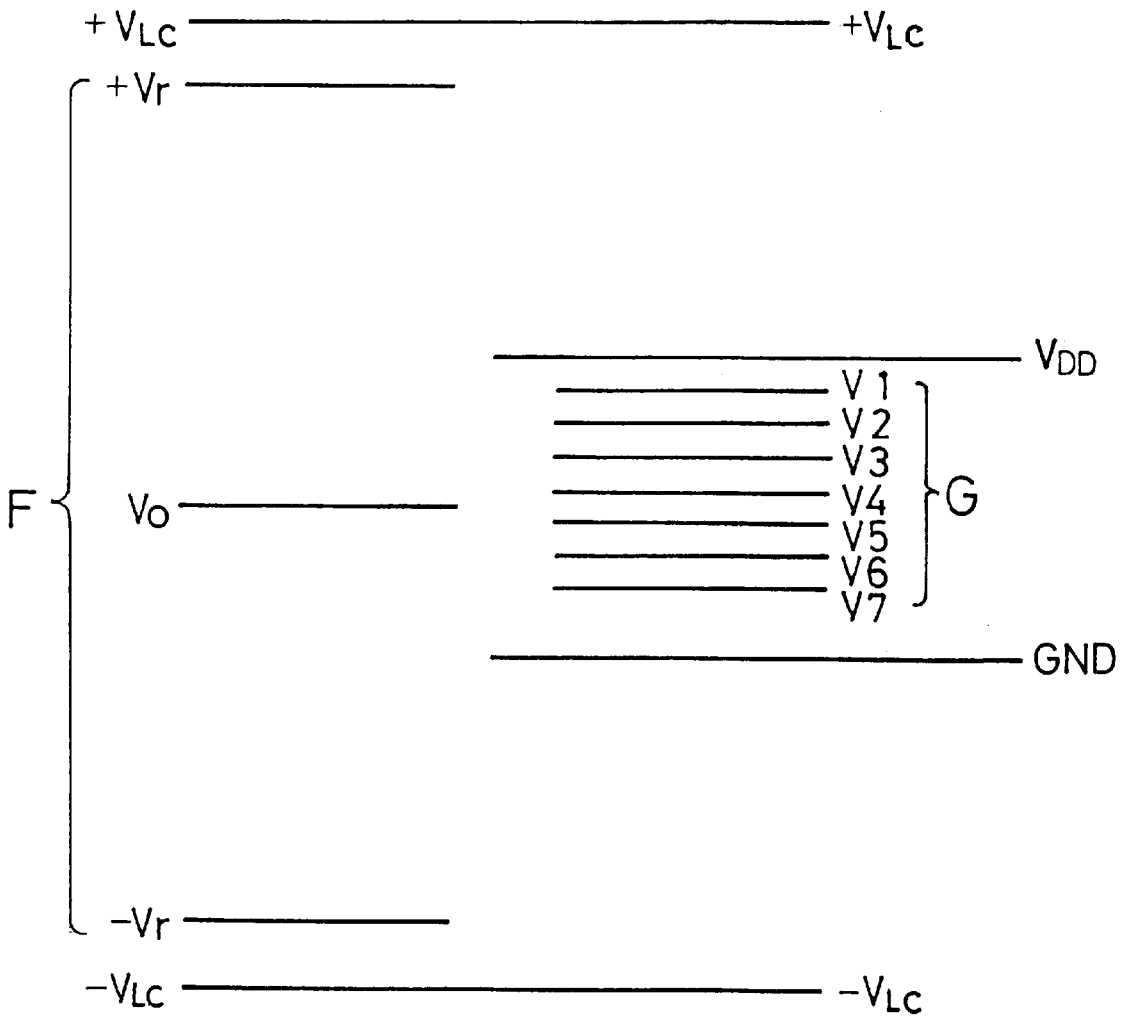
Figure 8:
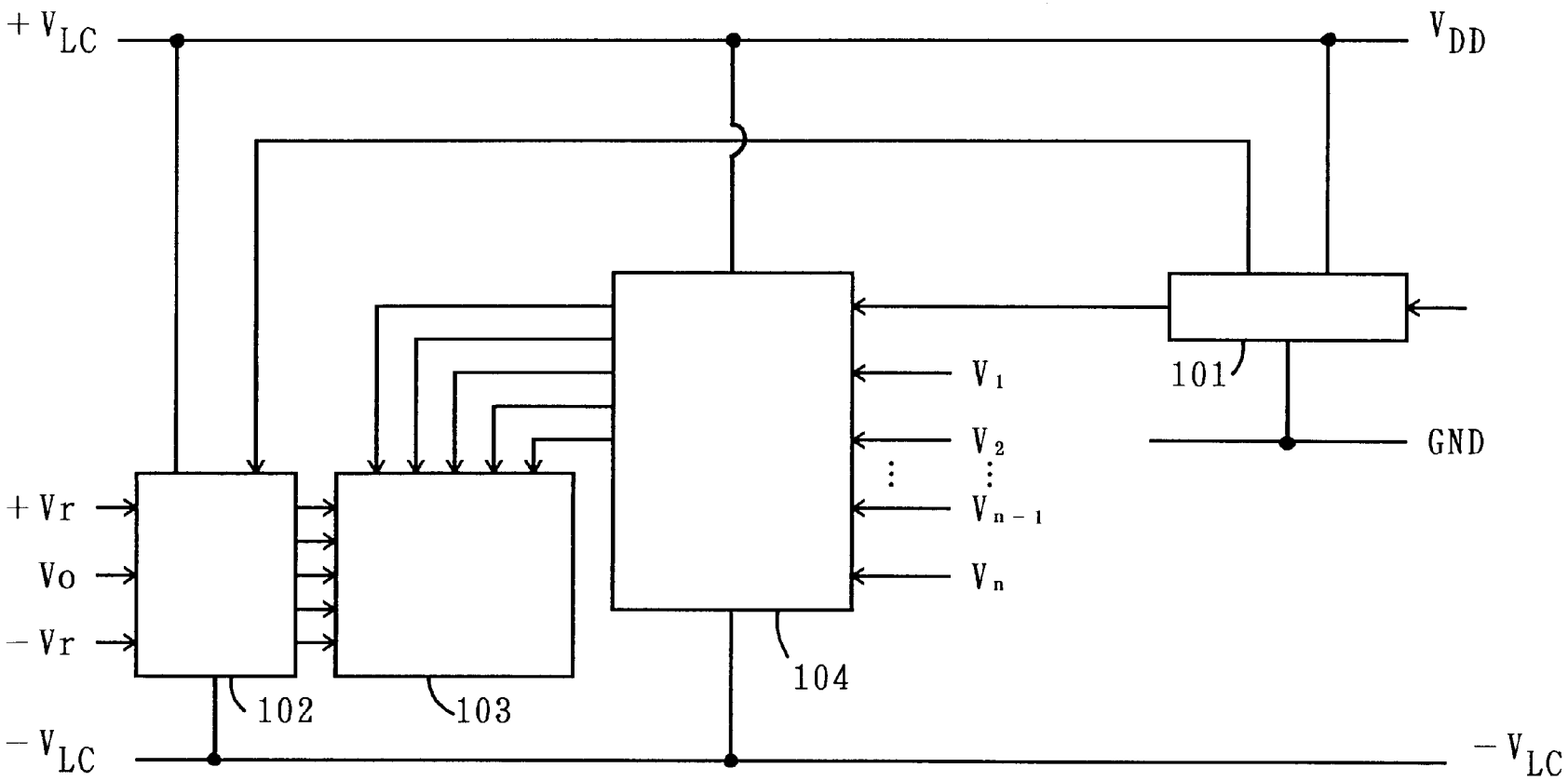

Lastly, FIG. 7 indicates the corresponding positional relationships of each voltage level supplied from the voltage level circuit shown in FIG. 6. As shown in the drawing, the three voltage levels +Vr, Vo and −Vr supplied to the common driver side are exist across the power supply voltage range output from the high voltage power supplies ($+V_{LC}$ and $-V_{LC}$). These three voltage levels are suitably selected in accordance with the orthonormal signal and a row driving wave form F is synthesized. The common driver is connected to the high voltage power supply side by this relationship. On the other hand, the seven voltage levels V1 to V7 exist within the range of power supply voltages output from the low voltage power supplies ($V_{DD}$ and GND). These seven voltage levels are suitably selected according to the sum of product signal and a column driving waveform G is synthesized. The segment driver is connected to the low voltage power supply side by this relationship. In the present embodiment the central potential (corresponding to Vo) of the voltage level supplied to the common driver side and the central potential (V4) of the voltage level supplied to the segment driver side are mutually in agreement. Accordingly, complete alternating current driving of the liquid crystal panel can be performed, and the application of DC components which cause display quality deterioration and lifetime deterioration can be prevented. To make matching of the central potential of the column driving waveform and the central potential of the row driving waveform easy, it is preferable that the central potential of the high voltage power supply and the central potential of the low voltage power supply be mutually in agreement. By making a central potential $V_4$ the comparison voltage of the comparator, a circuit for generating a comparison voltage can be omitted.

As explained above, according to the present invention, the common driver and segment driver are separately supplied by a pair of power supplies having different power supply voltages. For example, while the common driver is supplied by a high voltage power supply and outputs a relatively high voltage level row driving waveform, the segment driver is supplied by a low voltage power supply and outputs a relatively low voltage level column driving waveform. Since a high withstand voltage is not required with regard to at least the segment driver, it has the advantage that a normal IC can be applied and serves to reduce the cost. Also, because the segment driver and the controller supply power by means of a common low voltage power supply, they have an advantage in that the circuit construction can be simplified.

What is claimed is:

1. A display device for driving, in accordance with pixel data, a liquid crystal panel which comprises a liquid crystal material layer disposed between a plurality of column electrodes and a plurality of orthogonally opposing row electrodes defining a plurality of pixels arranged in a matrix, the display device comprising: a controller for producing orthonormal signals represented by a set of orthonormal functions and producing a sum of product signal in accordance with a result of a sum of product calculation with a set of the orthonormal functions and a set of pixel data; a common driver for applying row driving waveforms having a predetermined voltage level to the row electrodes by group sequential scanning at selected intervals in accordance with the orthonormal signals; a segment driver for applying column driving waveforms having a predetermined voltage level to the column electrodes in synchronization with the group sequential scanning in accordance with the sum of product signal; a low voltage power supply for providing a low level power supply voltage for driving the segment driver to output a relatively low voltage row driving waveform, and for commonly driving the controller; and a high voltage power supply for driving the common driver to output a relatively high voltage column driving waveform.

2. The display device according to claim 1, wherein the high voltage power supply outputs a power supply voltage greater than 10 V, and the low voltage power supply outputs a power supply voltage not greater than 10 V.

3. The display device according to claim 1, wherein the low voltage power supply provides a power supply voltage in the vicinity of 5 V in accordance with a rated voltage value of the controller.

4. The display device according to claim 3, wherein the segment driver outputs column driving waveforms having a voltage of approximately 5 V, and the common driver performs group sequential scanning of 15 or less row electrodes as one set.

5. The display device according to claim 4, wherein the common driver performs group sequential scanning of 6 row electrodes as one set.

6. The display device according to claim 1, wherein a central potential of a power supply voltage output by the high voltage power supply and a central potential of a power supply voltage output by the low voltage power supply are both substantially in agreement.

7. The display device according to claim 6, further comprising a voltage level circuit for dividing a power supply voltage output by the high voltage power supply to produce a plurality of voltage levels, and supplying one or more of the plural voltage levels to the segment driver for use in forming the column driving waveforms.

8. The display device according to claim 1, further comprising a level shifter for level shifting the orthonormal signals output from the controller driven by the low voltage power supply to input the signals to the common driver driven by a high voltage power supply.

9. The display device according to claim 1, wherein the common driver is driven by a high voltage power supply and is provided with an input comparator capable of directly receiving the orthonormal signals output from the controller driven by the low voltage power supply.

10. The display device according to claim 9, further comprising a voltage level circuit for dividing a power supply voltage output by the high voltage power supply to produce a plurality of voltage levels, and supplying one or more of the plural voltage levels to the segment driver for use in forming the column driving waveforms; wherein one of the plurality of voltage levels output by the voltage level circuit is utilized as a comparison voltage for determining a logic of the orthonormal signals output from the controller.

11. A display device for driving a simple matrix type liquid crystal panel which comprises a liquid crystal material layer disposed between a plurality of column electrodes and a plurality of opposing row electrodes defining a plurality of pixels arranged in a matrix, the display device comprising:

orthonormal function generating means for producing orthonormal signals represented by a set of orthonormal functions;

sum of product calculating means for producing a sum of product signal in accordance with a result of a sum of product calculation with the set of the orthonormal functions and a set of pixel data;

a common driver for applying row driving waveforms having a predetermined voltage level to the row electrodes by group sequential scanning at selected intervals in accordance with the orthonormal signals;

a segment driver for applying column driving waveforms having a predetermined voltage level to the column electrodes in accordance with the sum of product signal;

a low voltage power supply for driving the segment driver to output a relatively low voltage row driving waveform, and for commonly driving the sum of product calculating means; and a high voltage power supply for driving the common driver to output a relatively high voltage column driving waveform.

* * * * *